US010266997B2

(12) United States Patent
Tarmann

(10) Patent No.: US 10,266,997 B2
(45) Date of Patent: Apr. 23, 2019

(54) MILLING MACHINE FOR ROAD SURFACES OR PAVEMENTS

(71) Applicant: AQUATEC "IQ" Technologie GmbH, Villach (AT)

(72) Inventor: Jurgen Tarmann, Furnitz (AT)

( * ) Notice: Subject to any disclaimer, the term of this patent is extended or adjusted under 35 U.S.C. 154(b) by 0 days.

(21) Appl. No.: 15/544,203

(22) PCT Filed: Jan. 18, 2015

(86) PCT No.: PCT/IB2015/000037
§ 371 (c)(1),
(2) Date: Jul. 17, 2017

(87) PCT Pub. No.: WO2016/113583
PCT Pub. Date: Jul. 21, 2016

(65) Prior Publication Data
US 2018/0010306 A1 Jan. 11, 2018

(51) Int. Cl.
*E01C 23/09* (2006.01)
*E01C 23/01* (2006.01)
*E01C 23/088* (2006.01)

(52) U.S. Cl.
CPC ..... *E01C 23/0933* (2013.01); *E01C 23/01* (2013.01); *E01C 23/088* (2013.01); *E01C 23/0946* (2013.01); *E01C 23/0993* (2013.01)

(58) Field of Classification Search
CPC .. E01C 23/0885; E01C 23/0933; E01C 23/01; E01C 23/09; E01C 11/24
USPC ... 299/18, 36.1, 37.1, 38.1, 39.3, 39.4, 39.5, 299/48, 50, 51, 52, 54, 66, 73; 404/91, 404/94
See application file for complete search history.

(56) References Cited

U.S. PATENT DOCUMENTS 3,929,377 A * 12/1975 Weaver ..... E01C 23/088 299/1.5
4,392,689 A * 7/1983 Moore ..... E01C 23/0933 299/39.8
4,793,730 A * 12/1988 Butch ..... E01C 23/065 404/77
5,921,228 A * 7/1999 Watson ..... B28D 1/043 125/13.01
9,127,418 B2 * 9/2015 Bockes ..... E01C 23/0966
2006/0198703 A1 9/2006 Hall et al.
2007/0098496 A1 * 5/2007 Hall ..... C04B 26/26 404/94

FOREIGN PATENT DOCUMENTS

DE 29922773 U1 5/2000
DE 102010027328 A1 1/2012
WO 2010008351 A1 1/2010

OTHER PUBLICATIONS

International Search Report of the EPO; dated Sep. 23, 2015.

* cited by examiner

*Primary Examiner* — Carib A Oquendo
(74) *Attorney, Agent, or Firm* — Patshegen IP LLC; Moshe Pinchas

(57) ABSTRACT

The invention relates to a milling machine (100) comprising a bottom side (11) on which at least two milling heads (1*a*-1*f*) are individually movable and controllable in at least one translational movement (15*a*-15*f*) in one transverse rail (13*a*-13*f*) each, the rails running parallel to one another.

16 Claims, 9 Drawing Sheets

MILLING MACHINE FOR ROAD SURFACES OR PAVEMENTS

The present invention relates to a milling machine for the milling off or grooving of asphalt, concrete or other surface layers or road pavements, either fully or in strips. By way of example, it operates on motorways, roads, or other vehicular routes or aircraft taxiways, as well as take-off and landing strips or runways, and also on industrial floors or other extensive floor areas or surfaces.

Furthermore, the present invention relates to the type of milling known as 'precision-milling'; i.e. it does not involve replacing the entire asphalt layer, but only milling off the top surface, so that, once work is completed, it can be driven over immediately. A milling machine according to the present invention can be designed equally well as a vertical precision-milling machine—that is with vertical milling chisel disks—or as a precision-milling machine with milling drums. In addition it can be used for either cold milling or hot milling. Even though the latter involves less wear on the material of the tool(s) used, it is ecologically questionable in terms of energy balance.

Milling off—or simply grooving—these top layers or surfaces serves, in part, to correct warping formed for example by longitudinal lane grooves or wheel ruts, but also by braking on downhill stretches of road.

However, in general, milling off or grooving is carried out to produce or restore a flat surface, or to enhance the rough texture of the surface and to improve absorption, drainage and drying of surface water. Bowl-shaped depressions in the road surface as well as extensive hollowed stretches along the course of the road, where water can collect, are significant risk factors for the quality and safety of a road or motorway, from the point of view of aquaplaning and ice formation. What is more, the useful life of a road surface essentially depends on how frequently and regularly water can infiltrate its holes and pores, where it can freeze and so expand.

The so-called motorway 'connecting areas' are every bit as security-critical as so-called 'drainage water zones'. On motorways the term 'connecting areas' refers to those areas where a road with a transverse gradient, or inclination which is intentionally planned by motorway road constructors and is also mandatory, changes over to an opposite transverse gradient. Currently these 'connecting areas' are the subject of a research project being carried out by the Institute for the Design of Vehicular Traffic Roads at the Technical University Dresden, under the leadership of professor D.E.Sc. Christian Lippold. The minimum transverse gradient stipulated for road construction is 2.5%, whether in the form of a single-sided inclination or a roof shape inclination.

Furthermore, road surface markings and lane markings that have been applied too thickly are also security-critical. They may impede surface-water drainage.

In DE 10 2010 027 328 A1, disclosed on Jan. 19, 2012, the applicant Roekens GmbH of Rheine, Germany, used a so-called 'fluid milling machine', or more accurately a high-pressure water milling machine, or a sandblasting machine for roughening concrete. For this purpose, fixed pairs of nozzles are fitted to the underside of a self-driven or remotely-driven vehicle; these are supposed to ensure uniform roughening of a concrete road surface, without producing grooves. The milling device described is only suitable for concrete, and it has the major disadvantage that the roadway retains any unevenness and warping. Ridges and dips on the road's top surface are milled off to an equal degree. And it is not possible, for example, only to mill off the ridges down to the level of the dips. Consequently the useful purpose of the milling device described is essentially restricted to the roughening of newly poured, plane concrete road surfaces.

Another employment consists of milling several strips or grooves, in a parallel pattern, preferably running diagonally to the direction of travel. Such milling strips or grooves, respectively, are described in the German Utility Model DE 299 22 773 U1 registered on Jun. 29, 2000, by the applicant Blastrak-Morava, spol.s.r.o. of Brno, Czech Republic. These grooves are cut with a depth from 1 to 10 mm, a width from 5 to 300 mm, and a distance between the grooves from 10 to 200 mm.

Similar milling strips or grooves are described in WO 2010/008351 A1, disclosed on Jan. 21, 2010, by applicant Asfalteks D.O.O. of Ljubljana, Slovenia. These parallel milling strips running diagonally to the direction of travel can be seen on some stretches of road and problem spots especially on Slovenian and Croatian motorways. As studies and statistics show, they offer a significant improvement in motorway safety, especially in such spots as are prone to aquaplaning and black ice. The strips are milled to a depth of approx. 5 mm and, when driven over, they are scarcely audible or noticeable.

Producing such parallel milling strips, so that they run diagonally to the direction of travel, involves using a single milling machine for each strip individually. To achieve this, the single milling machine has to be steered or pushed by a workman into a position where it runs parallel to a strip that has already been milled off. This is labour-intensive and time-consuming. Another disadvantage of these single milling machines is that they have no measuring system allowing them to identify those particular spots where milling strips need to be introduced. This means the choice of locations relies upon statistics for accidents that have already occurred, rather than preventing accidents before they happen.

Schwamborn Gerätebau GmbH of Wangen, Germany, produces milling machines, for example the OMF 250, the BEF 320VX as well as the BEF 320EX. All of them are steered or pushed by a single workman and are capable of milling off individual strips by means of a single milling head. The downside to this type of milling machine is that it can only achieve its results piecemeal and with high working-time costs. Furthermore, its degree of precision very much depends on the eye of the workman steering or pushing the machine.

The object of the present invention is to provide a universal milling machine for all the applications described here; one that is more cost-efficient and is generally optimized in all its properties and applications; and one that will avoid the disadvantages indicated above.

The solution consists, in the first place, of an arrangement according to the present invention of at least two parallel milling heads that are movable and can be individually controlled, arranged on the underside of a milling machine pursuant to the present invention.

A milling machine according to the present invention is preferably self-propelled, but it can also have a coupling allowing it to be towed or pushed.

The preferred option is the self-propelled design and is preferably similar to a truck in construction and preferably it also has an adjustable crawling-speed that can be set for a uniform forward feed rate. The crawling-speed not only performs the function of maintaining a constant milling forward feed rate, for example when milling diagonal grooves, but at the same time it also functions as a brake, against the drive torque resulting from the action of the milling heads. The crawling-speed is preferably achieved by the milling machine's standard gearbox also including a reduction level, and preferably it also drives all the wheels of the milling machine. In addition, this reduced gear level can preferably also be engaged in reverse direction.

A further, but preferred option is a milling machine pursuant to the present invention that needs not be classed as a 'wide vehicle' and additionally can be driven independently from one site of use to another, at a truck's standard driving speed. For this purpose, it is further stipulated as preferable that the milling heads are arranged on carrier slides that run along transverse rails. These carrier slides are also individually controllable and extendable, so that they can project out beyond the width of the milling-machine or vehicle. In this case, the position of the carrier slides for the most part remains governed by the transverse rail. That is to say, for the sake of example, for a maximum truck width of 2.55 m, (which is in accordance with the EU regulation 96/53/EG), and a maximum motorway lane width of 3.75 m, the carrier slides preferably could each be extended telescopically by at least some 0.6 m on either side of the milling machine. In conformity with the present invention, it is thus ensured that, on the one hand, it is possible to drive from one place of work or use, to another, without need for special permission, whilst, on the other hand, a complete full-width motorway lane can be milled off.

One optional embodiment of the milling machine according to the present invention comes in a simpler embodiment without need for crawling-speed. However this also means it is restricted to milling strips or grooves, at a single, specified angle. In this embodiment the transverse rails are not aligned exactly across or perpendicularly to the direction of travel, but rather diagonally, for example, at an angle of 45 degrees. If it is a question of milling parallel diagonal strips, the milling machine only needs to stand still with the brakes on or in fixed stationary position, and the milling heads are driven on the diagonal rails.

The latter embodiment for a milling machine with diagonal rails, according to the present invention, can be firmly fixed on the road surface (if one prefers it to stand stationary) by using preferably hydraulic, or otherwise purely mechanical, supporting legs. According to preference, this provision for fixing the machine's position also involves a levelling apparatus with distance sensors for extending the supporting legs. In addition, preferably this levelling apparatus also includes detectors or sensors for detecting the milling machine's precise horizontal alignment. In this way it is possible, on the one hand, to align the milling machine's fixed position precisely to the transverse gradient of the motorway section in question. On the other hand, it is also possible to measure the transverse gradient of the stretch of motorway on which the milling machine happens to be standing, or along which it is moving. If measurements show that the stretch of motorway has a good transverse gradient, consistent depth milling strips or grooves, respectively, may be all that is needed. However if the measurements show that the stretch of motorway is standing precisely "in the water" meaning that it is exactly horizontal, it is possible to create a milling strip or groove, respectively preferably in direction Z and using milling heads whose working-depth is controllable. The strips or grooves should have increasing depth and should give a transverse gradient or inclination, respectively, in the range of about 0.5 to 5%, by preference 2.5%.

The embodiment of a milling machine according to the present invention, with transverse rails arranged perpendicularly to the direction of travel, is preferably fitted with a stabilizing apparatus comprising supporting wheels. These supporting wheels are also extendable, either mechanically or preferably hydraulically, onto the road surface, and during operation they can run along the road surface. Such a support apparatus, comprising preferably a minimum of four individual supporting wheels, is preferably further combined with the levelling apparatus described above.

With one optional embodiment of a milling machine, conforming to the present invention, the chassis/running gear i.e. the suspension, shock absorbers and also possibly the stabilizers, can be switched to a stable and non-swaying working position. Besides this, provision can also be made to increase the tyre pressures temporarily, for the duration of the milling process. By these means, or by using the supporting wheels or the supporting legs, or by a combination of all of these options, it is ensured that the milling machine sways or swings as little as possible during operation, so that the milling strips or grooves, respectively, are as exact as possible.

The preferred truck-type design of a milling machine, according to the present invention, preferably also includes a tank for water or preferably for biodegradable cooling lubricants and a cooling and lubricating unit, as well as a suction unit for capturing the milling waste and collecting it in a container.

Each individual milling head can be fitted with at least one spray nozzle and one suction nozzle, and furthermore preferably in such a disposition that the spray nozzle is arranged in front of the milling head in the direction of the milling process, and that the suction nozzle is arranged behind. Moreover, a protective screen can surround the milling heads.

For cost reasons the preferred suction unit for a milling machine, according to the present invention, consists of a single suction channel, that is also preferably arranged transversely to the milling machine's underside. Moreover, preferably it is also telescopically extendable as far as the milling machines extended working width by means of the carrier slides. One or more rotating brushes can in addition flank this suction channel.

In conformity with the present invention, the individual drives for each milling head can run on separate electric- or servomotors. For this purpose, one electro- or servomotor can be stipulated for the milling head's rotational drive, and a second such motor for the forward feed motion. With the milling machine embodiment according to the present invention that has transverse rails running perpendicularly to the direction of travel, the forward feed motion arises from the vector sum of the rail drive direction plus the drive direction of the milling machine. With the milling machine according to the present invention that has diagonal rails, the milling heads' forward feed motion simply corresponds with the rail drive direction.

Furthermore the individual drive for each milling head according to the present invention can also be powered by hydraulic oil-pump motors.

However, a purely mechanical-built embodiment of a milling machine according to the present invention involves a main driveshaft that is optionally, but preferably, raised into the space above the milling head by the medium of two cardan joints.

As a rule, the main driveshaft is fitted in the milling machine lengthwise, and from it, using for example a bevel-differential gear, ancillary shaft drives branch off at a 90-degree angle, one for each individual milling drive. In addition to this, the main driveshaft is, as a rule, fitted at the center of the milling machine, so that it is also preferable to have two ancillary shafts drives branching off symmetrically from either side of the main driveshaft, at a 90-degree angle. However in this case it is necessary to synchronize the rotation directions of each of the two ancillary shaft drives, or rather bring their rotation into alignment, by using another exemplary differential gear. Each of the end points of the ancillary shaft drive is preferably fitted with a spur gear for powering the milling driveshaft that runs continuously across the total width of the milling machine. To this milling driveshaft is fitted a drive housing, with a bevel gear and the milling head. Thus, rotation of the main driveshaft in one direction or the other, with appropriate rotation speed, has the effect of making the milling heads rotate in the appropriate direction and with the appropriate rotation speed.

The necessary forward feed motion of the milling heads within the transverse rail or on the carrier slide (and at the same time the operation of the milling driveshaft) is catered for by a servomotor. As an alternative to this however, a rack and pinion drive is used, with a spur gear that engages the toothed rack, arranged parallel to the milling driveshaft. Optionally, it is also possible to mount a worm gear on a threaded spindle, instead of using a rack and pinion gear.

A further preferred embodiment of the electrical single-drive, or of the hydraulic single-drive, is provided for by wheel hub motors, designed preferably so as to be replaceable as easily as possible.

Of course, it is also possible to combine the three different drive types, to cater for the rotational movement of the milling head and for the forward feed motion. In conformity with the present invention, the forward feed motion of each milling head consists of the milling head's translational movement within the carrier slide, together with the carrier slide's translational movement within the transverse rail. And in so far as it concerns the embodiment of a milling machine according to the present invention with transverse rails fitted perpendicularly to the direction of travel, the milling machine's forward and backward movement preferably at crawling-speed contributes additionally to this.

The forward feed motion of each milling head as explained above, or if one prefers, the compound effect of the carrier slide drive in the transverse rail and the milling head's translational milling head drive in the carrier slide, can be coupled with the milling head's rotational drive, in so far as these two are directly proportional to each other. That is to say that a high rotational speed in the rotation drive also generates rapid forward feed motion. This is the case equally for the embodiment of milling machines with single electric drives according to the present invention, for the embodiment of milling machines with single hydraulic drives according also to the present invention, for the embodiment of milling machines with single mechanical drives according further to the present invention, or for any combinations of these embodiments. However forward feed motion of the milling heads that can be controlled independently of the rotation drive is preferable, by using, for example, separate servomotors for the forward feed motion.

In particular the mechanical-design milling machines according to the present invention, but also optionally the other disclosed embodiments, can preferably be fitted with wear-resistant, maintenance-free Teflon bearings, roller bearings, or deep-groove ball bearings.

The milling heads of a milling machine according to the present invention are preferably designed for both up-cut milling and synchronous milling. They can also be hob-cutting heads, where both the infeed and the forward feed motion are radial. The hob-cutting heads are preferably already of the same width as the required milling strip and preferably they also have replaceable cutters. However, face-milling heads can also be considered; there the infeed is axial and the forward feed motion is radial. Face milling heads can have several cutters that are preferably replaceable. Or they are furnished with only one, which would then correspond to the so-called single-tooth cutting technique.

In principle, water jets and sandblasting nozzles can be considered also as milling tools.

The milling heads taken as a whole are preferably exchangeable. Thus it is not only possible to mill parallel milling strips but also plane surfaces, either by using broader milling heads or by an optional adjustability of the milling head, perpendicularly to the forward feed motion, which means that they are closer together.

The infeed and forward feed motion of the individual milling heads are preferably monitored by using optoelectronic position sensors, or glass measuring bars, or either incremental or absolute position sensors, or magnetic strips. They are furthermore preferably recorded and controllable by computer and preferably displayed in the driver's cabin. According to preference, this unit also involves corresponding sensors for monitoring the rotation speed of the driven axles and milling heads, making it in consequence a combined position sensor system and rotation monitoring system.

A milling machine according to the present invention also comprises preferably an optoelectronic recording system that can preferably fulfil the four following functions with computer support in conformity with the present invention:

1) Recording and measuring of milling strips already milled in an adjacent traffic lane, so that the milling heads can be aligned accordingly and the new strips can be milled so as continue on exactly from the ones that have already been milled;
2) Recording, measuring and aligning the milling machine so that it is precisely in the middle of a traffic lane, and precisely parallel with the traffic lane markings. This ensures that the angle of the milling strips is correct;
3) Recording and measuring the transverse gradient of the carriageway, or the traffic, or motorway lane, so that it can be determined whereabouts over the course of the road and in which direction milling strips should be milled;
4) Recording and measuring any depressions in a stretch of road, so that zones that are of their very nature poorly drained can be identified.

According to preference, the optoelectronic recording system comprises a minimum of two different types of recording, or rather sensors as they are nowadays known, and that are already in use. These are cameras, both mono and stereo, and laser scanners. To enhance the usefulness of camera images taken at night, thermal-imaging cameras should in principle be considered; however the preferred option is a combination of optical sensors and radar. This combination ensures precision even at night, and is hardly dependent on weather conditions. This would then amount precisely to an 'opto-electro-magnetic' recording system.

For measuring distances at close quarters, ultrasonic sensors should also be considered.

One option is to integrate a GPS module into the controlling computer. This ensures, for example, that coordinates transmitted by a control center can be found precisely.

A further possible option is to make provision for spraying a sealant of water-repellent silicon resin or a modified polymer cationic bitumen emulsion onto the milling strip from a designated spray nozzle, following milling off, cleaning, or suction-drainage.

The various disclosed embodiments of milling machines conforming to the present invention can be combined with each other in any desired way, in regard to the features not relevant to basic functionality. For example, all the embodiments described here can be combined with the crawling-speed feature as described or the telescopic carrier slides, as well as the stabilizing and levelling apparatus as described. This is irrespective of whether it is the embodiments using servomotors, hydraulic oil pump motors, or wheel hub motors, or those with purely mechanical functionality, with a rack and pinion gear or a spindle. In addition to this, all the embodiments described can be fitted just as readily with roller milling heads as with face milling heads, with a cooling lubrication unit and suction unit as well as with an optoelectronic recording system, with or without radar.

The present application discloses a procedure for simultaneous milling of several parallel milling strips on a stretch of motorway, using a milling machine as disclosed, with the following basic procedural steps:

a)—Moving the milling machine to a place of use specified in advance;
b)—If no place of use is specified in advance, recording and measuring of potential places of use whilst in movement, with the opto-electro-magnetic recording system;
c)—Recording and measuring of the transverse gradient of the carriageway;
d)—Recording and measuring of the center of the traffic lane and of road markings;
e)—Aligning the milling machine in the center of the first traffic lane and parallel with the road markings;
f)—Extending the supporting legs down to the road surface;
g)—Stabilizing and levelling the milling machine with the stabilizing and levelling apparatus;
h)—Extending the milling heads and the carrier slides so that the milling heads project over the first traffic lane's first road markings;
i)—Switching on the cooling and lubrication unit;
j)—Switching on the cleaning and suction unit;
k)—Applying the milling heads to the road surface, with milling dimension Z;
l)—Activation of the forward feed drive;
m)—Milling of strips as far as the second road marking in the first traffic lane;
n)—Driving back the milling heads in direction Z;
o)—Switching off the cooling and lubrication unit;
p)—Switching off the cleaning and suction unit;
q)—Retracting the milling heads and the carrier slides;
r)—Retracting the supporting legs;
s)—Moving the milling machine to a second traffic lane adjacent to the first one;
t)—Recording and measuring the ends of the milling strips at the transition point between the first traffic lane and the second traffic lane;
u)—Aligning the milling machine to the second traffic lane;
v)—Repeating procedural steps d)-s), and so on.

The present application discloses a second procedure for simultaneous milling of several parallel milling strips on a stretch of motorway, using a milling machine as disclosed, with the following basic procedural steps:

a')—Moving the milling machine to a place of use specified in advance;
b')—If no place of use is specified in advance, recording and measuring of potential places of use whilst in movement, with the opto-electro-magnetic recording system;
c')—Recording and measuring of transverse gradient of the carriageway;
d')—Recording and measuring of the center of the traffic lanes and of road markings;
e')—Aligning of the milling machine in the center of the first traffic lane and parallel with the road markings;
f')—Extending the supporting wheels down to the road surface, or switching on the chassis/running gear working position stabilization apparatus;
g')—Stabilizing and levelling the milling machine with the stabilizing and levelling apparatus;
h')—Extending the milling heads and the carrier slides so that the milling heads project over the first traffic lane's first road markings;
i')—Switching on the cooling and lubrication unit;
j')—Switching on the cleaning and suction unit;
k')—Applying the milling heads to the road surface, with milling dimension Z;
l')—Activation of translational movement and simultaneous activation of crawling-speed;
m')—Milling of strips as far as the second road marking in the first traffic lane;
n')—Driving back the milling heads in direction Z;
o')—Switching off the cooling and lubrication unit;
p')—Switching off the cleaning and suction unit;
q')—Retracting the milling heads and the carrier slides;
r')—Retracting the supporting wheels, or switching off the chassis/running gear working position stabilization apparatus;
s')—Moving the milling machine to a second traffic lane adjacent to the first one;
t')—Recording and measuring the ends of the milling strips at the transition point between the first traffic lane and the second traffic lane;
u')—Aligning the milling machine to the second traffic lane;
v')—Repeating procedural steps d')-s'), and so on.

A milling machine according to the present invention has the following advantages:

It can mill grooves or milling strips, respectively, as well as whole surfaces.

It significantly improves road safety in respect of the dangers of aquaplaning and ice formation on wet surfaces.

It significantly improves water drainage, thus increasing the service life of the road surface.

It eliminates the build up of water around too thickly applied road markings.

It is suitable for asphalt and concrete as well as other materials used for road surfaces, regardless of whether the surface covering is new and still flat, or old and warped.

It saves labour as well as time, because it makes it possible to mill not just one single milling strip, but several simultaneously and automatically by machine.

It has at its disposal an optoelectronic recording system, allowing it to record a traffic lane's transverse gradient as well as depressions along the road. This makes it possible to identify the ideal places for applying milling strips.

The optoelectronic recording system makes it possible in the first place to apply milling strips on a first traffic lane, before subsequently continuing the same strips with complete precision on a second lane. This makes complete closure of both traffic lanes unnecessary.

A milling machine according to the present invention can also function in darkness thanks to its optoelectronic recording system.

It supplies a precision-machined milling result.

It can be driven independently from one place of use to another.

It has no excess-width and consequently requires no special permission for its journeys. Even though a milling machine according to the present invention has no excess-width, it can still mill off a complete lane width.

If appropriately equipped, a milling machine according to the present invention can be stabilized and levelled during milling operations, by means of stabilizing and levelling apparatus.

A milling machine according to the present invention can mill off strips with an upward or downward gradient.

Cooling lubrication is used for milling, and the milling waste is abstracted by suction and directly removed.

Further advantageous design features of a milling machine according to the present invention constitute the subject matter of the subsidiary claims.

The list of reference numbers/signs is constituting part of the disclosure.

With the help of the figures, the present invention is explained more detailed and in a symbolic and exemplary manner. These figures will be described coherently and comprehensively. They are schematic and exemplary representations, and are not drawn to scale, not even in the individual components' relation to each other. A particular reference number/sign always refers to the same component. Reference numbers/signs with different indices refer to components with the same function or to similar components.

In this context

Figure 6:
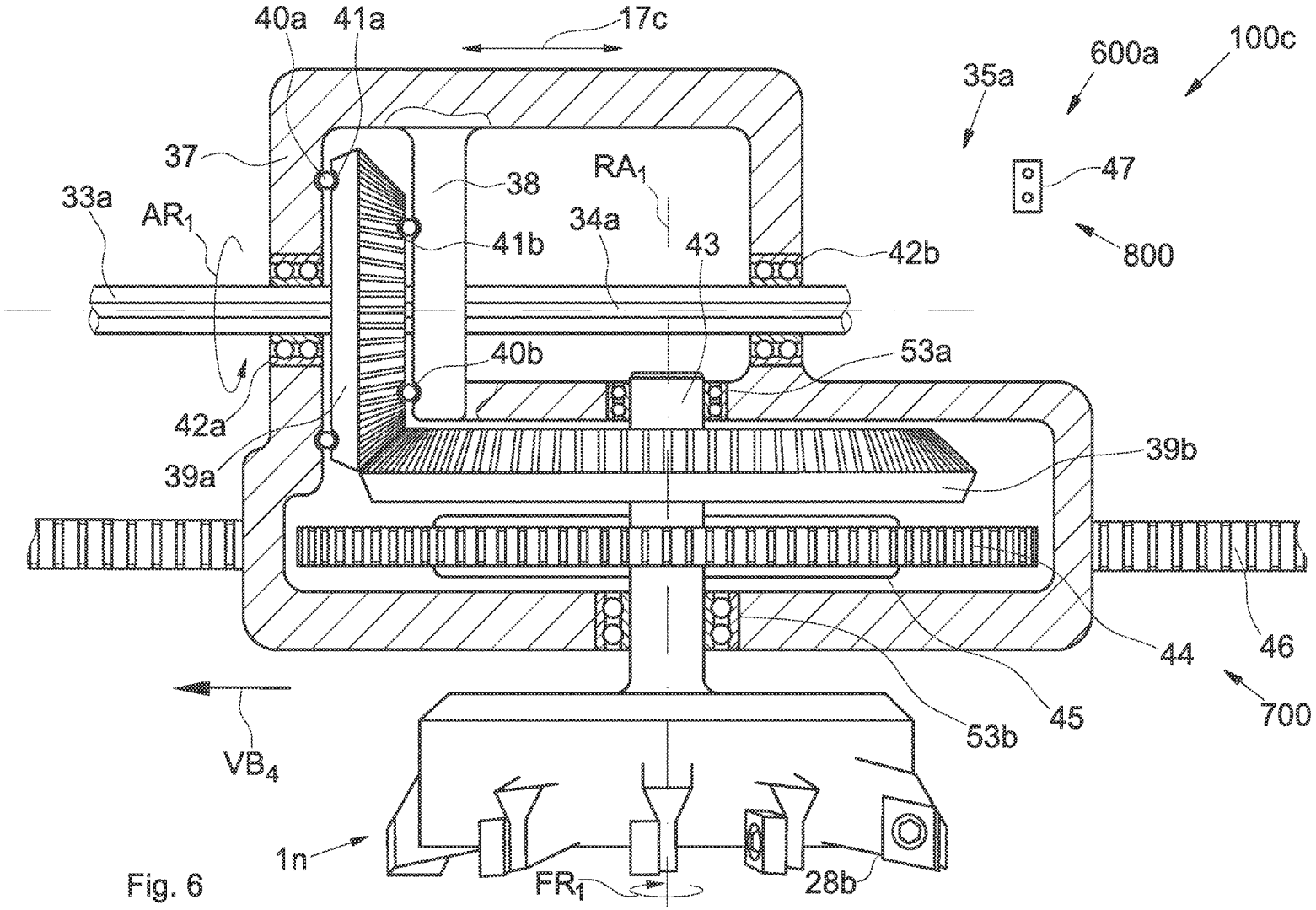
FIG. 6 is a schematic representation of a drive housing used in an exemplary fourth, purely mechanical embodiment of a milling machine according to the present invention.
Figure 7B:
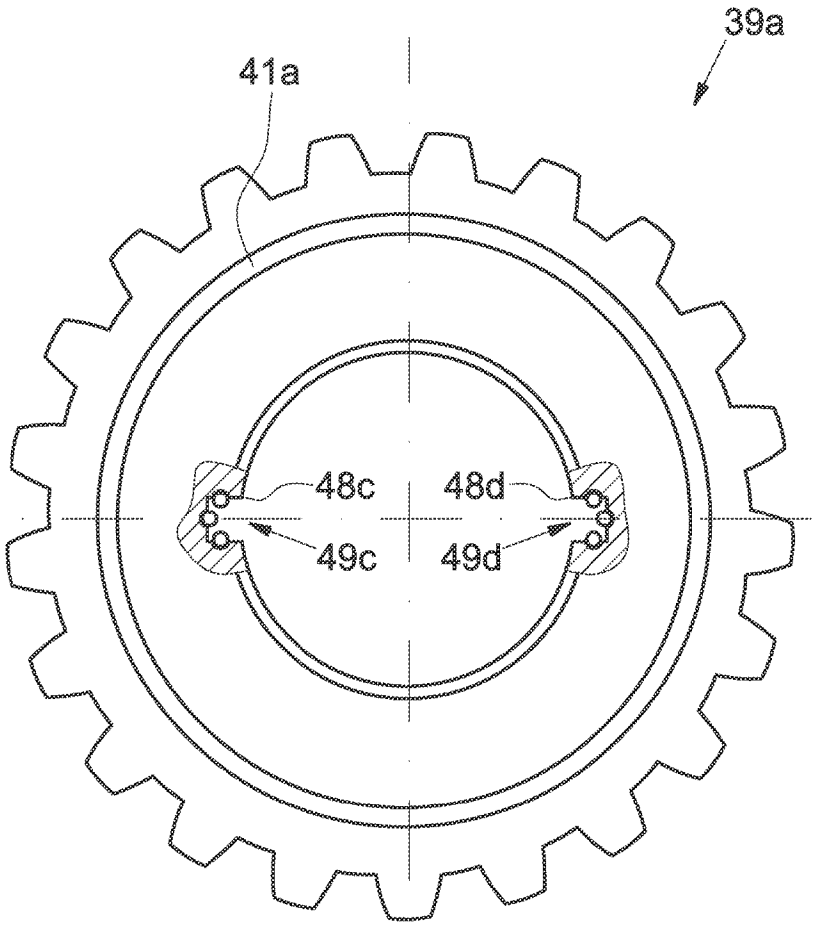
Figure 7A:
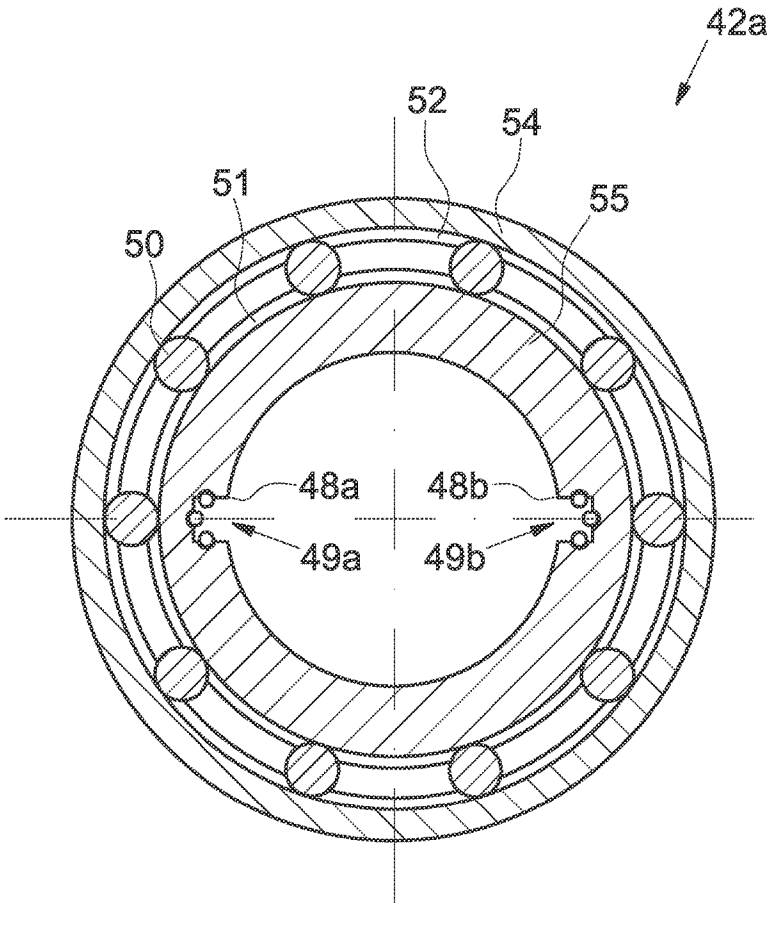
Figure 8:
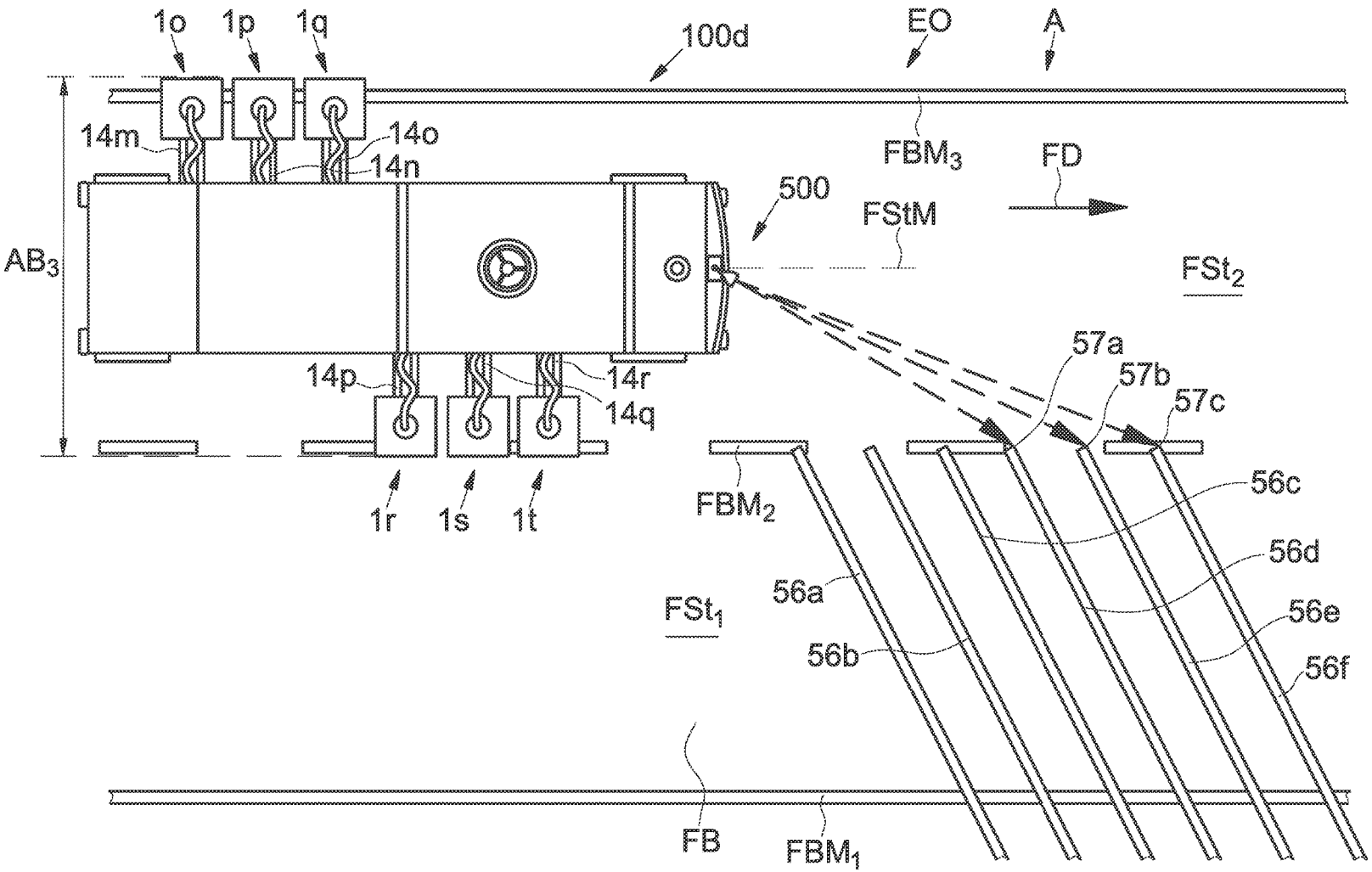
Figure 9:
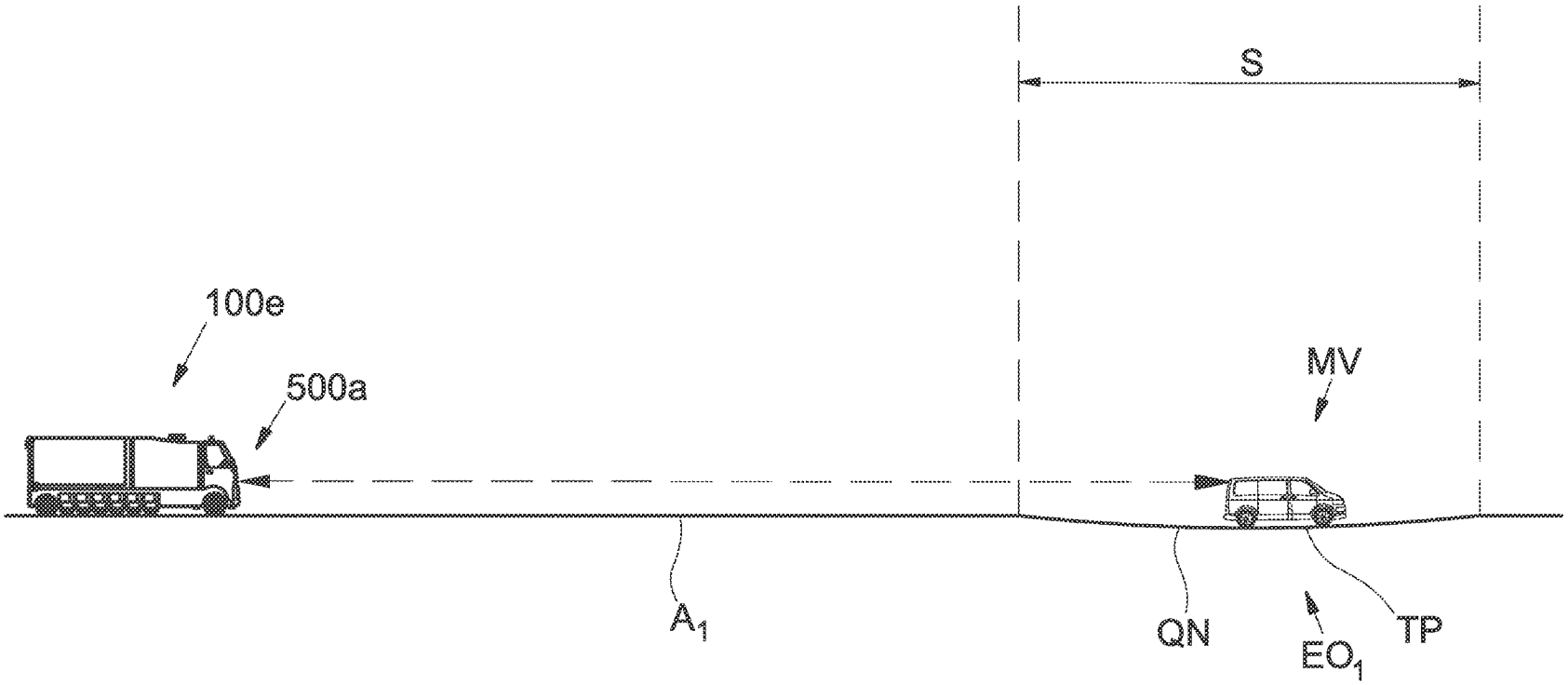

FIG. 7*a* is a schematic representation of a special grooved-ball bearing integrated into the drive housing shown in FIG. 6;

FIG. 7*b* is a schematic representation of a special bevel gear, which is also integrated into the drive housing shown in FIG. 6;

FIG. 8 is a schematic representation from the bird's eye view, of an exemplary fifth embodiment of a milling machine according to the present invention, it is seen milling off a second traffic lane in a procedure according to the present invention;

FIG. 9 is a schematic representation of an exemplary sixth embodiment of a milling machine according to the present invention, with a device also according to the present invention for detecting depressions along the length of the road.

Figure 1:
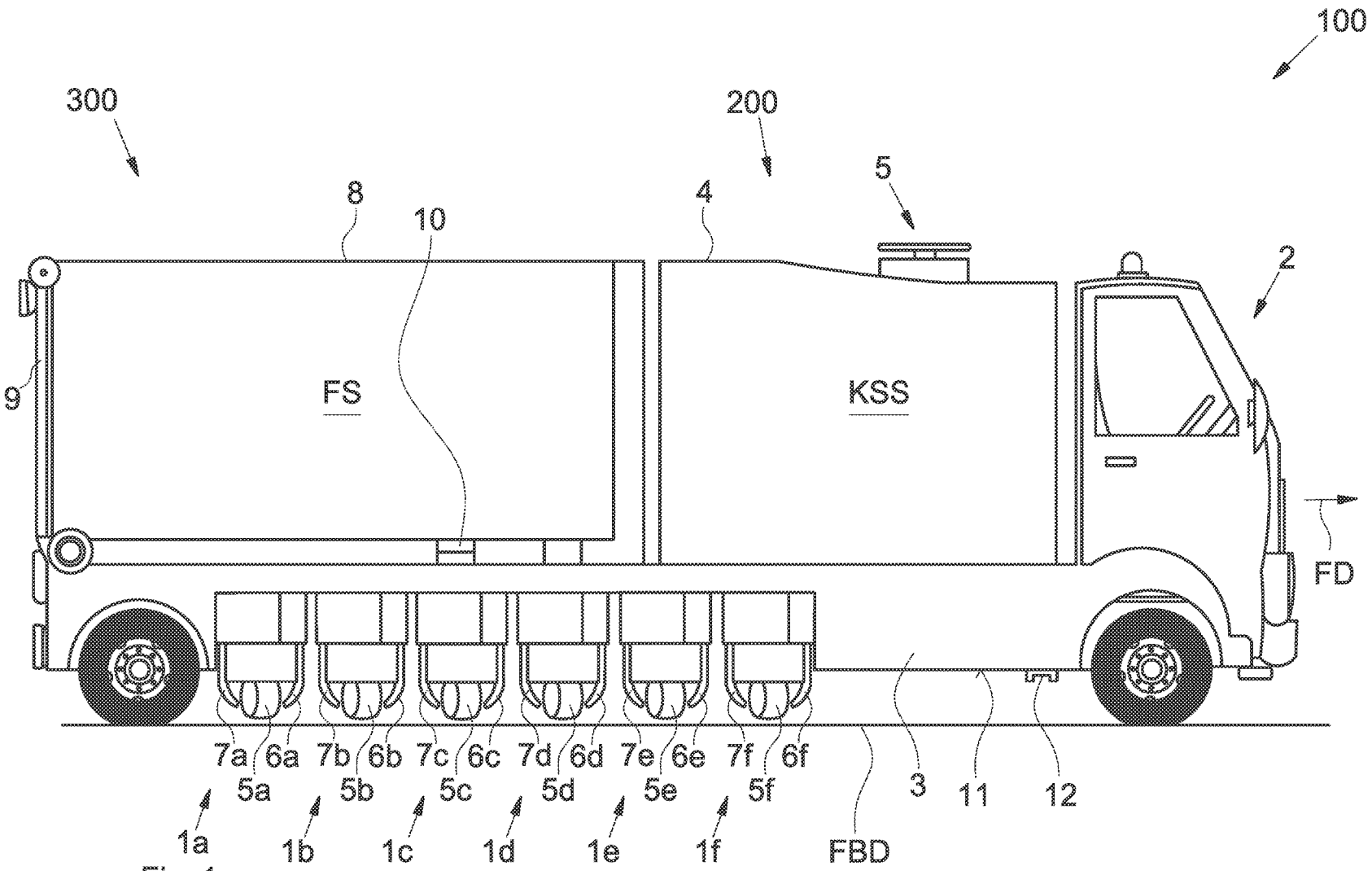
FIG. 1 is a schematic representation of an exemplary, first embodiment of a milling machine according to the present invention that is by preference similar to a truck in construction.

FIG. 1 shows the exemplary first embodiment of a milling machine 100 according to the present invention, which is similar to a truck in construction. It consists of a driver's cab 2, a load-bearing chassis or ladder frame 3, as well as a cooling-lubricant tank 4, with a filling cap 5, for cooling lubricant KSS. The load-bearing chassis or ladder frame 3, is fitted with milling heads 1*a*-1*f*, with milling drums 5*a*-5*f*, each of which is flanked by a spray nozzle 6*a*-6*f* for cooling lubricant KSS as well as by a suction nozzle 7*a*-7*f*.

Spraying nozzles 6*a*-6*f*, the connection lines (not shown in detail) to the cooling lubricant tank 4, as well as the control unit, again not shown in detail, are part of a cooling and lubrication unit 200.

In turn, suction nozzles 7*a*-7*f* are components of a cleaning and suction unit 300, that includes a container 8 for the abstracted milling waste FS. Container 8 can be emptied by flap 9 and a hydraulic cylinder 10. An underside 11 of the load-bearing chassis or ladder frame 3 is fitted with hydraulic supporting legs, of these only hydraulic supporting leg 12 can be seen in this side view illustration. These hydraulic supporting legs 12 can be extended down to the road surface FBD, thus stabilizing the milling machine 100 during milling operation.

Figure 2:
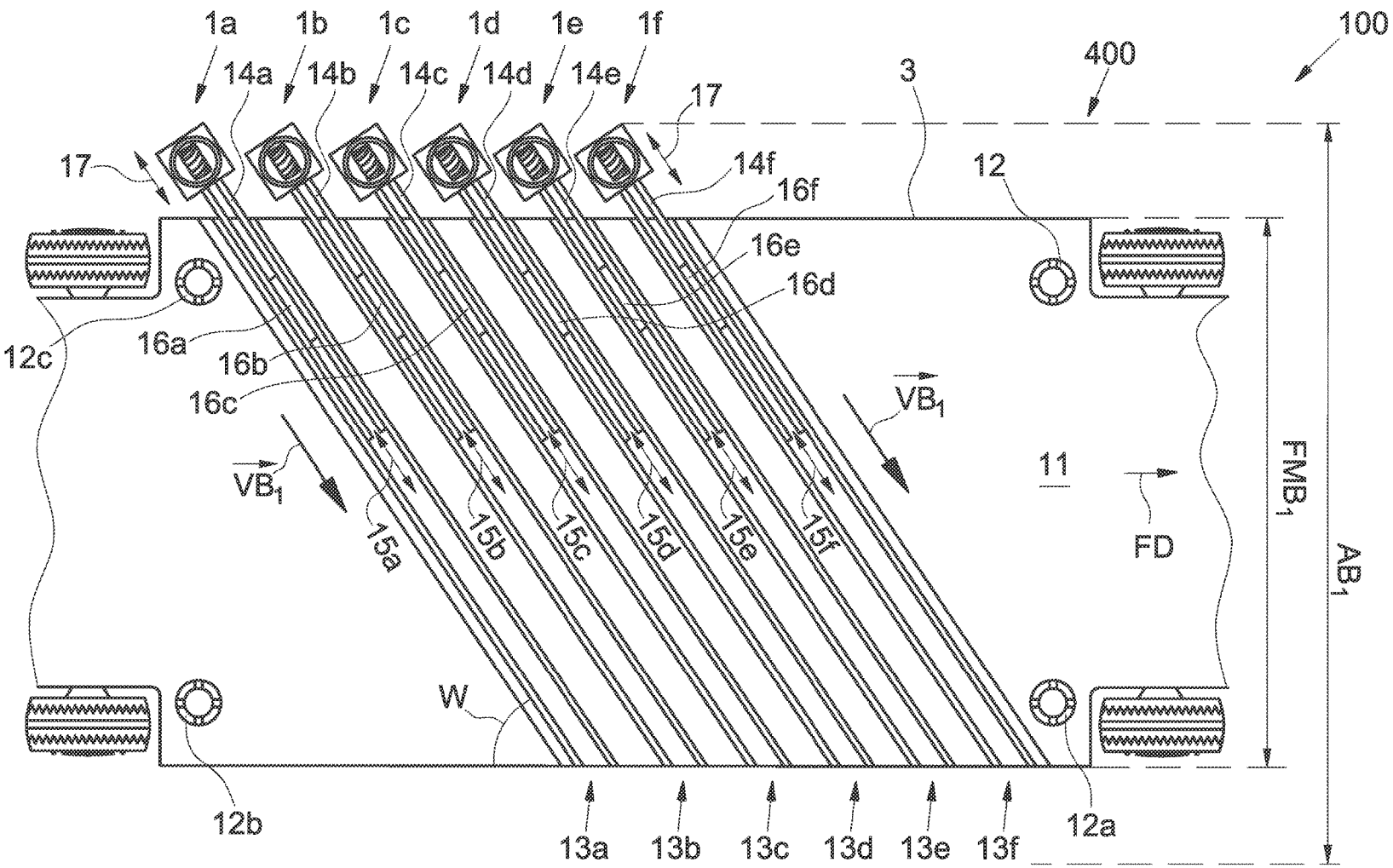
FIG. 2 is a schematic representation of the underside of a milling machine according to the present invention shown in FIG. 1, with transverse rails fitted diagonally.

FIG. 2 shows the underside 11 of the milling machine 100 presented in FIG. 1, or respectively, of the load-bearing chassis or ladder frame 3. This view also shows the other supporting legs 12*a*-12*c*, which are a component of a stabilizing and levelling apparatus 400. Transverse rails 13*a*-13*f* are arranged at an angle W of approximately 45 degrees. A carrier slide 14*a*-14*f* can run along each of them, each in a translational direction of displacement 15*a*-15*f*, and each driven by a servomotor 16*a*-16*f*.

Carrier slides 14*a*-14*f* are telescopically extendable on both sides of the milling machine 100, each on its own transverse rail 13*a*-13*f*. They can project beyond milling machine width $FMB_1$, to the extent of a working width $AB_1$, which ideally corresponds to the maximum width of a traffic lane.

The milling heads 1*a*-1*f* can be driven by servomotors (not shown in detail) in a single direction of displacement 17, on their individual carrier slides 14*a*-14*f*. The vector sum of the translational direction of displacement 15*a*-15*f*, of the carrier slides 14*a*-14*f* and of the displacement motion 17 of the milling heads 1*a*-1*f* results in the forward feed motion $VB_1$. This again highlights the fact that—with the stationary milling machine 100, fixed and levelled by means of the supporting legs 12, 12*a*-12*c* and the stabilizing and levelling apparatus 400, it is possible for milling heads 1*a*-1*f* to mill off the required diagonal grooves or milling strips, respectively, just by means of the forward feed motion $VB_1$ along the transverse rails at an angle of approximately 45 degrees.

Figure 3:
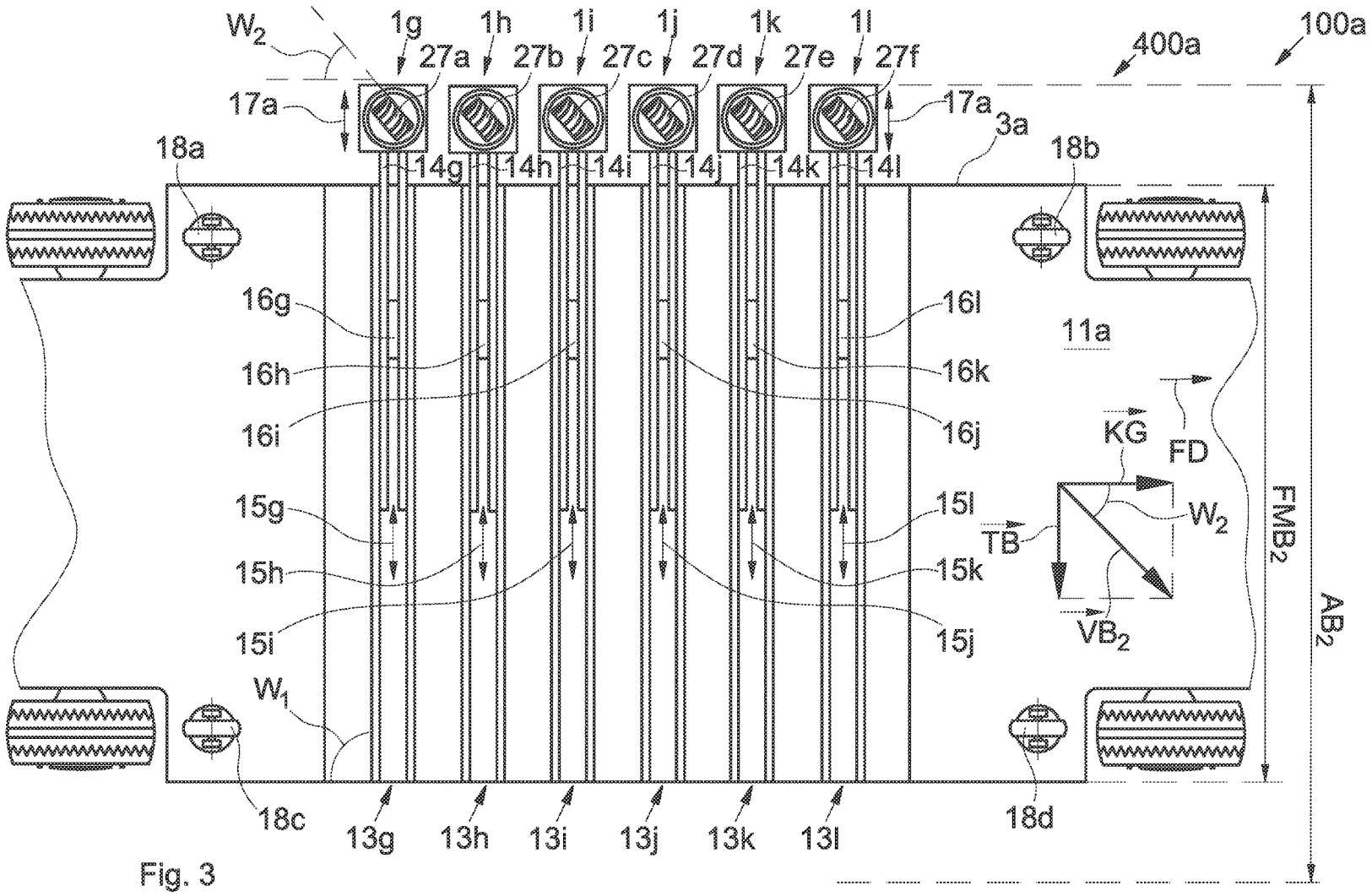
FIG. 3 is a schematic representation of the underside of an exemplary second embodiment of a milling machine according to the present invention, with transverse rails fitted perpendicularly to the direction of travel.

FIG. 3 shows a schematic illustration of a second embodiment of a milling machine 100*a* according to the present invention, with an underside 11*a* of a load-bearing chassis or ladder frame 3*a*. This time transverse rails 13*g*-13*l* are arranged at an angle $W_1$ of 90 degrees, which is perpendicular to the direction of travel and this is given by crawling speed KG. Each of the transverse rails 13*g*-13*l* is fitted with carrier slides 14*g*-14*l*, and these can be driven by servomotors 16*g*-16*l* in the corresponding translational direction of displacement 15*g*-15*l*. This means that they can be telescopically extended to a width projecting beyond milling machine width $FMB_2$, as far as working width $AB_2$. What's more, it is also possible to drive milling heads 1*g*-1*l* on their individual carrier slides 14*g*-14*l*, in a single direction of displacement 17*b*.

This results in a translational movement TB, which is any arbitrary combination of the displacement 15*g*-15*l* of the carrier slides 14*g*-14*l* and the displacement 17*a* of the milling heads 1*g*-1*l*. The fact that, with this embodiment 100*a* of a milling machine according to invention, the milling process is carried out whilst the machine is moving, preferably at crawling speed KG, results in the forward feed motion $VB_2$, which represents the vector sum of the translational movement TB and the crawling speed KG. This means that the identity between or synchronization of, respectively, crawling speed KG and translational movement TB result in forward feed motion $VB_2$, that is then aligned to the direction of travel at an angle W of 45 degrees. Yet, if those two movements (KG and TB) are not identical or synchronized, respectively, the result is a different angle, which is determined by the ratio of the velocities of the two movements. In this way, it is possible to mill off milling strips in any optional angle.

Only schematically depicted milling drums 27*a*-27*f* on milling heads 1*g*-1*l*, are aligned at the same angle $W_2$. This feature is lost if milling heads 1*g*-1*l* are arranged with face milling heads instead of milling drums 27*a*-27*f*.

Before engaging crawling speed KG, the milling machine 100*a* is stabilized and levelled preferably by means of stabilizing and levelling apparatus 400*a*, that, amongst other things, also includes supporting wheels 18*a*-18*d* movable in direction Z.

Figure 4:
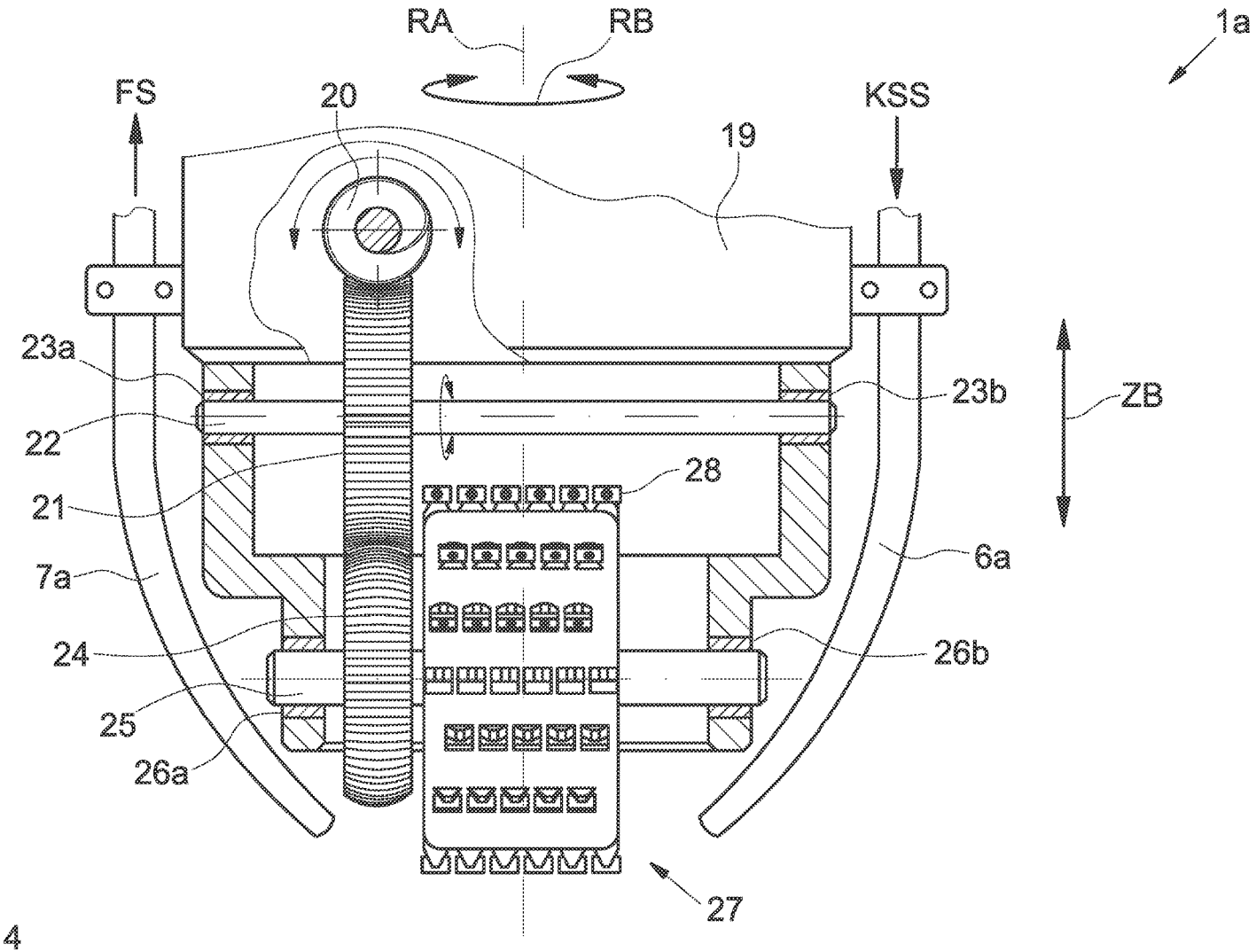
FIG. 4 is a schematic representation of an exemplary embodiment of a milling head also according to the present invention, used for a milling machine according to the present invention.

FIG. 4 shows milling head 1*a*, from the FIGS. 1 and 2, that includes a cylinder 19. Rotating around axis RA, with rotation movement RB, the cylinder can be aligned in any required milling direction. This cylinder 19 is fitted with a spraying nozzle 6*a* for cooling lubricant KSS, and with a suction nozzle 7*a* for milling-waste FS. In the illustration these two nozzles are arranged at the sides of milling drum 27, however it is also possible for spraying nozzle 6*a* to be arranged in front of milling drum 27, and the suction line 7*a* behind it. The whole milling head 1*a* can be delivered in direction Z, with infeed motion ZB.

An electric motor or hydraulic oil pump motor (not represented in detail here) can be used to drive a milling head 1*a* constructed to this design. For example this can drive a worm 20, which in turn drives a first worm wheel 21, which is fixed on a first axle-shaft 22, so as to be torque-proof. The latter is mounted on pivot bearings 23*a* and 23*b*. The first worm wheel 21 drives a second worm wheel 24, which is fitted in torque-proof fashion on a second axle-shaft 25, which is again mounted on pivot bearings 26*a* and 26*b*. The same applies to the milling drum 27, which is arranged as torque-proof on the second axle-shaft 25. The drum has rows of individual blades 28, with exchangeable cutting inserts.

Figure 5:
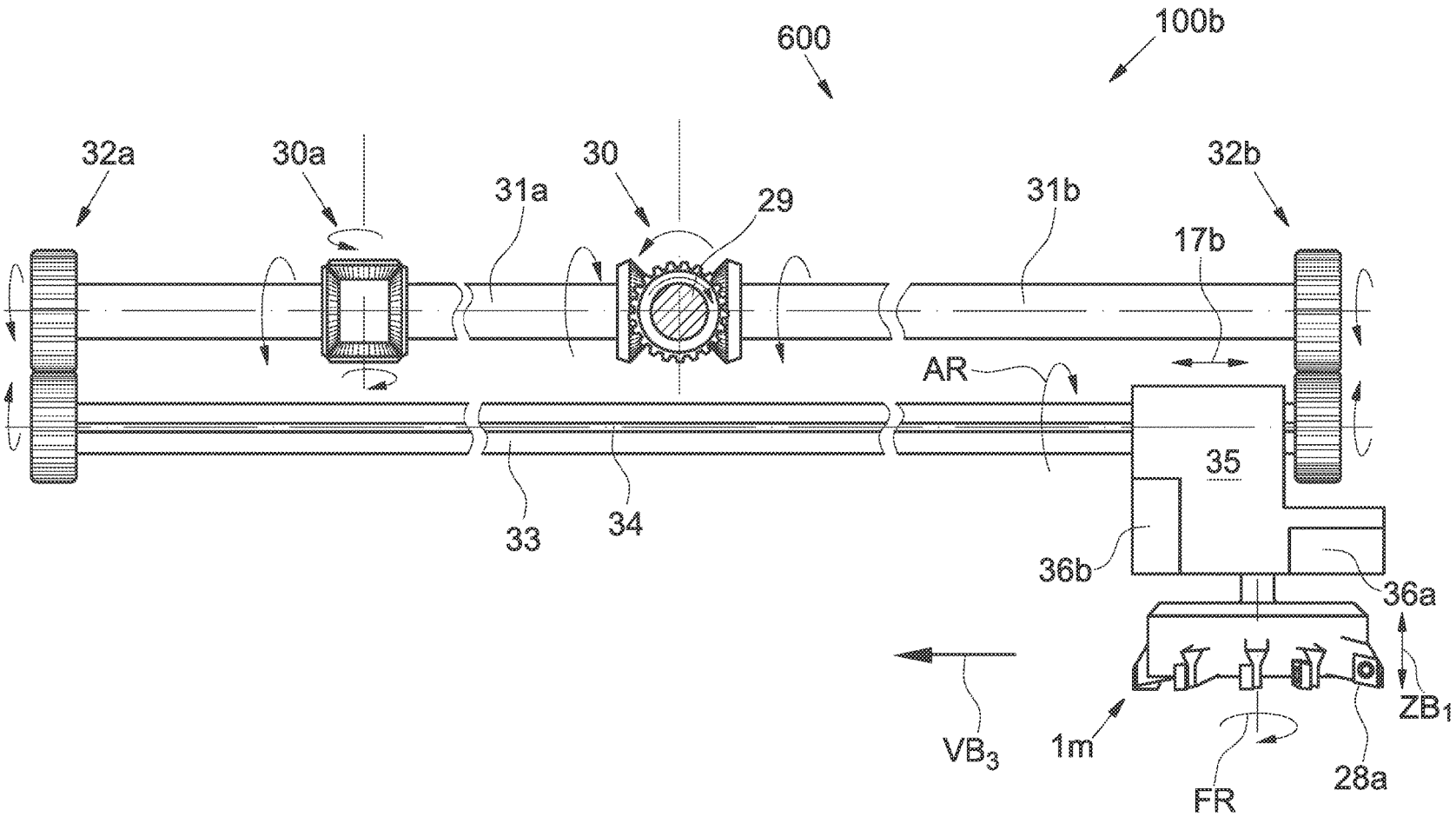
FIG. 5 is a schematic representation of a mechanical drive used in an exemplary third embodiment of a milling machine according to the present invention.

FIG. 5 is a schematic illustration of a mechanical drive unit 600 taken as an example for a further milling machine 100*b* according to the present invention. Ancillary drive shafts 31*a* and 31*b* branch off from a main driveshaft 29, using a differential 30, one for each. Another mediating differential 30*a* is arranged on ancillary driveshaft 31*a*, ensuring that rotation in the corresponding spur gears 32*a* and 32*b* is synchronized. These two spur gears 32*a* and 32*b* turn driveshaft 33, which has a continuous hub 34. The hub 34 and preferably, a further hub in a diametrically opposed direction, operates with drive rotation AR and, by means of a bevel gear (not shown in detail here in FIG. 5) inside drive housing 35, drives milling head 1*m*, with the corresponding milling rotation FR. In this case the head is a face milling head, and its outer circumference is furnished with individual blades 28*a*, preferably with exchangeable cutting inserts.

Merely indicated here, a servomotor 36*a* is accommodated in drive housing 35; it caters for an infeed motion $ZB_1$ of milling head 1*m*. Also only indicated here, is servomotor 36*b* that takes care of a displacement movement 17*b* along driveshaft 33. In this case the displacement movement 17*b* corresponds to a forward feed movement $VB_3$.

FIG. 6 shows a drive housing 35*a*, which functions purely mechanically and is used in another embodiment of a milling machine 100*c* according to the present invention. Between a housing wall 37 and a mounting ring 38 there is the first bevel gear wheel 39*a*. Its bearings are such that, courtesy of sphere rings 40*a* and 40*b*, it can rotate freely in circular grooves 41*a* and 41*b*. At the same time, the first bevel gear wheel 39*a* is torque-proof, but axially displaceable being mounted on driveshaft 33*a* with a hub 34*a*.

Driveshaft 33*a* is mounted on special ball bearings 42*a* and 42*b*, which will be described in greater detail in a subsequent figure. In any case, these special ball bearings 42*a* and 42*b* allow for radial direction, whilst at the same time driveshaft 33*a* remains axially displaceable. Thus it is ensured, in conformity with the present invention, that drive-housing 35*a* taps drive rotation $AR_1$ from driveshaft 33*a*, for rotation $FR_1$of the milling head. At the same time it remains movable in the direction of displacement 17*c*.

The first bevel gear wheel 39*a* engages a second bevel gear wheel 39*b* that is again mounted on the milling head shaft 43 so as to be torque-proof. The latter has double-deep-groove ball bearings 53*a* and 53*b* and rotates around the rotation axle $RA_1$. In addition to this, the milling head shaft 43, which is also mounted so as to be torque-proof, is furnished with a front toothed wheel 44, which engages a toothed gear 46 by means of an aperture 45 at the rear of the housing. The front toothed wheel 44 and the gear rack 46 are components of a rack and pinion gear 700. With a purely mechanical drive unit 600*a*, as illustrated here, the drive rotation $AR_1$ of the driveshaft 33*a* causes both the milling rotation $FR_1$, as well as the simultaneous forward feed motion $VB_4$.

Furthermore it can also be seen in FIG. 6 that the milling head 1*n* is fitted with individual blades 28*b*, with exchangeable cutting inserts, and that a motion restrictor 47 limits the displacement movement 17*c*, by making the drive rotation $AR_1$ stop. The motion restrictor 47 is preferably a component of a position sensor and rotation monitoring system 800.

FIG. 7*a* shows special ball bearing 42*a*, from FIG. 6 in a cutaway view. The balls 50 move along an outer channel 52 of an outer ring 54, and along an inner channel 51 of an inner ring 55. The latter has inside grooves 48*a* and 48*b*, which are diametrically opposed to each other. Each of them has its own ball bearings 49*a* and 49*b* or Teflon bearings that transmit the drive rotation $AR_1$ of the inner driveshaft 33*a* from FIG. 6 radially. However, axially they remain displaceable—that is perpendicularly in the drawing layer. For this purpose, hub 34*a* in FIG. 6 can have longitudinal grooves that correspond to ball bearings 49*a* and 49*b*.

The same applies by analogy with bevel wheel 39*a* in FIG. 7*b*, where the inside grooves 48*c* and 48*d* with the ball bearings 49*c* and 49*d* hold radially, but not axially.

FIG. 8 is a schematic representation of a milling machine 100*d* at a place of use EO, which is a motorway A, consisting of a carriageway FB, a first traffic lane $FSt_1$ and a second traffic lane $FSt_2$. Traffic lanes $FSt_1$ and $FSt_2$ are defined by road markings $FBM_1$-$FBM_3$. The first traffic lane $FSt_1$ has already been milled with milling strips 56*a*-56*f* running diagonally to the direction of travel FD.

The milling machine 100*d*, similarly to the milling machine in FIG. 3, is fitted with carrier slides 14*m*-14*r* perpendicular to the direction of travel FD, with their respective milling heads 1*o*-1*t*. It is on the second traffic lane $FSt_2$ approaching the previously milled strips 56*a*-56*f*, preferably in balance with the three milling heads 1*o*-1*q* on the left-hand side, and the milling heads 1*r*-1*t* on the right-hand side, each extended to the maximum working width $AB_3$.

It is sufficient to record and measure the milling strips ends 57*a*-57*c* of milling strips 56*d*-56*f* as well as the center of traffic lane FStM, by means of an optoelectronic recording system 500. Because then, milling heads 1*r*-1*t* will start continuing milling strips 56*d*-56*f*, precision milling them over road marking $FBM_2$ and road marking $FBM_3$. Coming from the opposite direction the milling strips made by milling heads 1*o*-1*q* will be automatically aligned with strips 56*a*-56*c*, provided the milling machine that made strips 56*a*-56*f* was of the same kind, with the same settings.

FIG. 9 is a schematic representation, showing a milling machine 100*e* equipped with an optoelectronic recording system 500*a*, by way of example escorted by a white Multivan MV driving ahead of it. With computer assistance it can measure and record both a depression S and its lowest point TP along the course of a motorway $A_1$, as well as the transverse gradient QN, thus enabling it to identify a new place of use $EO_1$.

LIST OF REFERENCE NUMBERS/SIGNS

1*a*-1*t*—milling head
2—driver's cabin
3, 3*a*—load-bearing chassis, or ladder frame, respectively
4—cooling lubricant tank
5—filling cap
6*a*-6*f*—spraying nozzle
7*a*-7*f*—suction nozzle
8—milling waste container
9—flap door
10—hydraulic cylinder
11, 11*a*—bottom side, underside of 3
12, 12*a*-12*c*—hydraulic supporting leg
13*a*-13*l*—transverse rail
14*a*-14*r*—carrier slide
15*a*-15*l*—translational movement, translational direction of displacement of 14
16*a*-16*l*—servomotor
17, 17*a*-17*c*—displacement motion of 1
18*a*-18*d*—supporting wheel
19—cylinder
20—worm
21—first worm wheel
22—first axle shaft
23*a*, 23*b*—pivot bearing
24—second worm wheel
25—second axle shaft
26*a*, 26*b*—pivot bearing
27, 27*a*-27*f*—milling drum
28, 28*a*, 28*b*—individual blade
29—main driveshaft
30, 30*a*—differential
31*a*, 31*b*—ancillary driveshaft
32*a*, 32*b*—spur gear
33, 33*a*—driveshaft
34, 34*a*—hub
35, 35*a*—drive housing
36*a*, 36*b*—servomotor
37—housing wall
38—mounting ring
39*a*, 39*b*—bevel gear wheel
40*a*, 40*b*—sphere ring
41*a*, 41*b*—circular groove
42*a*, 42*b*—special ball bearing
43—milling head shaft
44—front toothed wheel
45—housing aperture
46—gear rack
47—motion restrictor
48*a*-48*d*—inside groove
49*a*-49*d*—ball bearing, Teflon bearing
50—ball
51—inner channel
52—outer channel
53*a*, 53*b*—double deep-groove ball bearing
54—outer ring
55—inner ring
56*a*-56*f*—milling strip
57*a*-57*c*—milling strip end
100, 100*a*-100*e*—milling machine
200—cooling and lubrication unit
300—cleaning and suction unit
400, 400*a*—stabilizing and levelling apparatus
500, 500*a*—optoelectronic recording system
600, 600*a*—mechanical drive unit
700—rack and pinion gear
800—position sensor and rotation monitoring system
A, $A_1$—motorway
$AB_1$-$AB_3$—working width
AR, $AR_1$—drive rotation
EO, $EO_1$—place of use
FB—carriageway
$FBM_1$-$FBM_3$—traffic lane marking
FBD—road surface
FD—direction of travel
$FMB_1$-$FMB_2$—milling machine width
FR, $FR_1$—milling rotation
FS—milling waste
$FSt_1$, $FSt_2$—traffic lane
FStM—traffic lane center
KG—crawling speed
KSS—cooling lubricant
MV—Multivan
QN—transverse gradient, inclination
RA, $RA_1$—rotation axle
RB—rotation movement
S—depression
TB—translational movement
TP—lowest point
$VB_1$-$VB_4$—forward feed motion
W, $W_1$, $W_2$—angle
ZB, $ZB_1$—infeed motion

The invention claimed is:

1. Milling machine comprising:

at least two rails disposed in parallel to one another and extend transversely along a path extending between two sides of an underside of the milling machine said path extends beyond the width of said underside on either side of said two sides;

each one of said at least two rails includes a carrier slide sildably mounted in said rail; and each one of said at least two rails includes a milling head, being displaceably mounted in said carrier and having a single milling drum; said milling head being configured to be individually displaced in said carrier along said path and to rotate together with said milling drum along an axis transverse to said rail.

2. Milling machine according to claim 1, wherein each carrier slide telescopically extended in one of said at least two rails, exceeding width of the milling machine as far as to a working width.

3. Milling machine according to claim 1, characterized in that the rails are arranged at an angle which is diagonal to a direction of travel of the milling machine-and a forward feed motion of the milling heads is composed of a displacement motion of the milling heads on the carrier slides and of a translational displacement direction of the carrier slides on the transverse rails.

4. Milling machine according to claim 1, characterized in that the rails are arranged at a 90-degree angle, perpendicular to a direction of travel of the milling machine, and a forward feed motion of the milling heads is composed of a milling heads' displacement motion on the carrier slides and of a translational movement of the carrier slides in the rails and of a crawling speed in the direction of travel.

5. Milling machine according to claim 1, characterized in that the milling machine further comprises a stabilizing and levelling apparatus, with supporting legs or supporting wheels.

6. Milling machine according to claim 1, characterized in that the milling machine comprises a chassis/running gear stabilization, which stiffens a suspension and shock absorbers of the milling machine.

7. Milling machine according to claim 1, characterized in that the milling heads are deliverable in direction Z by means of an infeed motion and milling strips are millable in an inclination, which lies in a range of 0.5-5%.

8. Milling machine according to claim 1, further comprising a cooling and lubrication unit and a cleaning and suction unit.

9. Milling machine according to claim 1, characterized in that a drive rotation as well as a milling rotation and a forward feed motion are producible by means of electric motors.

10. Milling machine according to claim 1, characterized in that a drive rotation as well as a milling rotation and a forward feed motion are producible by means of hydraulic oil pump motors.

11. Milling machine according to claim 1, characterized in that a drive rotation as well as a milling rotation and a forward feed motion are producible by means of a mechanical drive that comprises a rack and pinion gear or a spindle drive.

12. Milling machine according to claim 1, characterized in that a drive rotation as well as a milling rotation and a forward feed motion are producible by means of wheel hub motors.

13. Milling machine according to claim 1, characterized in that an infeed motions of the milling heads and a forward feed motions of the milling heads are monitorable by means of a position sensor and a sensor for monitoring rotation.

14. Milling machine according to claim 1, characterized in that the milling machine comprises an optoelectronic sensor, which identifies a traffic lane center, ends of previously milled milling strips, a traffic lane's transverse gradient and depressions along a carriageway.

15. Procedure for applying the milling machine in accordance with claim 14, is characterized in that the following procedural steps are carried out:

a)—Moving the milling machine to a place of use specified in advance;

b)—If no place of use is specified in advance, recording and measuring of potential places of use whilst in movement, with theoptoelectronic sensor;

c)—Recording and measuring of a transverse gradient of carriageway;

d)—Recording and measuring a center of traffic lanes and of road markings;

e)—Aligning the milling machine in the center of the first traffic lane and parallel with the road markings;

f)—Extending supporting legs down to a road surface;

g)—Stabilizing and levelling the milling machine with a stabilizing and levelling apparatus;

h)—Extending the milling heads and a carrier slides so that the milling heads project over a first traffic lane's first road markings;

i)—Switching on a cooling and lubrication unit;

j)—Switching on the cleaning and suction unit;

k)—Applying the milling heads to the road surface, with milling dimension Z;

l)—Activation of a forward feed drive;

m)—Milling of strips as far as a second road marking in the first traffic lane;

n)—Driving back the milling heads in direction Z;

o)—Switching off the cooling and lubrication unit;

p)—Switching off the cleaning and suction unit;

q)—Retracting the milling heads and the carrier slides;

r)—Retracting the supporting legs;

s)—Moving the milling machine to a second traffic lane adjacent to the first one;

t)—Recording and measuring a ends of the milling strips at a transition point between the first traffic lane and the second traffic lane;

u)—Aligning the milling machine to the second traffic lane;

v)—Repeating procedural steps d)-s), and so on.

16. Procedure for applying the milling machine in accordance with claim 14, is characterized in that the following procedural steps are carried out:

a')—Moving the milling machine to a place of use specified in advance;

b')—If no place of use is specified in advance, recording and measuring of potential places of use whilst in movement, with theoptoelectronic sensor;

c')—Recording and measuring of a transverse gradient of carriageway;

d')—Recording and measuring of a road lane center and of road markings;

e')—Aligning of the milling machine in a center of the first traffic lane and parallel with the road markings;

f')—Extending supporting wheels down to a road surface, or switching on a chassis/running gear working position stabilization apparatus;

g')—Stabilizing and levelling the milling machine with a stabilizing and levelling apparatus;

h')—Extending the milling heads an a carrier slides so that the milling heads project over the first traffic lane's first road marking;

i')—Switching on a cooling and lubrication unit;

j')—Switching on a cleaning and suction unit;

k')—Applying the milling heads to the road surface, with milling dimension Z;

l')—Activation of translational movement and simultaneously, activation of crawling speed;

m')—Milling of strips as far as the second road marking in the first traffic lane;

n')—Driving back the milling heads in direction Z;

o')—Switching off the cooling and lubrication unit;

p')—Switching off the cleaning and suction unit;

q')—Retracting the milling heads and the carrier slides;

r')—Retracting the supporting wheels, or switching off the chassis/running gear working position stabilization apparatus;

s')—Moving the milling machine to a second traffic lane adjacent to the first one;

t')—Recording and measuring the ends of the milling strips at a transition point between the first traffic lane and the second traffic lane;

u')—aligning of the milling machine to the second traffic lane;

v')—Repeating procedural steps d')-s'), and so on.

* * * * *